US010677024B2

(12) United States Patent
Schultz

(10) Patent No.: US 10,677,024 B2
(45) Date of Patent: Jun. 9, 2020

(54) ABRASIVE PERFORATOR WITH FLUID BYPASS

(71) Applicant: Thru Tubing Solutions, Inc., Oklahoma City, OK (US)

(72) Inventor: Roger L. Schultz, Ninnekah, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 199 days.

(21) Appl. No.: 15/446,586

(22) Filed: Mar. 1, 2017

(65) Prior Publication Data

US 2018/0252078 A1 Sep. 6, 2018

(51) Int. Cl.

| | |
|---|---|
| ***E21B 43/114*** | (2006.01) |
| ***E21B 34/14*** | (2006.01) |
| ***E21B 34/10*** | (2006.01) |
| ***E21B 34/06*** | (2006.01) |
| *E21B 34/00* | (2006.01) |

(52) U.S. Cl.

CPC ..... *E21B 43/114* (2013.01); *E21B 34/063* (2013.01); *E21B 34/10* (2013.01); *E21B 34/103* (2013.01); *E21B 2034/007* (2013.01)

(58) Field of Classification Search

CPC .. E21B 43/114; E21B 2034/007; E21B 34/14; E21B 21/103

See application file for complete search history.

(56) References Cited

U.S. PATENT DOCUMENTS

| | | | |
|---|---|---|---|
| 1,279,333 | A | 9/1918 | Green |
| 1,980,012 | A | 11/1934 | Stelling |
| 1,996,070 | A | 4/1935 | Honel et al. |
| 2,004,051 | A | 6/1935 | LeMaire |
| 2,006,091 | A | 6/1935 | Walter |

(Continued)

FOREIGN PATENT DOCUMENTS

| | | | |
|---|---|---|---|
| AR | 090826 | A1 | 12/2014 |
| AU | 2012256028 | | 1/2017 |

(Continued)

OTHER PUBLICATIONS

Korean Intellectual Property Office, Notification of Transmittal of the International Search Report and the Written Opinion of the International Searching Authority, dated Feb. 27, 2012, in PCT/US2011/046056, corresponding to the above-identified application.

*Primary Examiner* — Catherine Loikith
(74) *Attorney, Agent, or Firm* — Mary M. Lee

(57) ABSTRACT

An abrasive perforator tool with a bypass flow channel. Two valve sleeves are slidingly mounted inside a tool housing for sequential deployment. The valve sleeves may be arranged end-to-end and may be sealed to the inside diameter of the housing. Each of the valve sleeves may be telescopically mounted in a retainer sleeve and releasably secured in the undeployed position. When the valve sleeves are ball-actuated, the ball seat in the first valve sleeve may be at the lower end of the sleeve. Initially, with both sleeves in the undeployed position, fluid flows straight through the main bore and out the outlet end. When the first valve sleeve is deployed, fluid is redirected to the nozzles for perforating, and subsequent deployment of the second valve sleeve blocks the nozzles and opens the bypass channel to reestablish flow out through the bottom of the tool.

29 Claims, 11 Drawing Sheets

(56) References Cited

U.S. PATENT DOCUMENTS

| | | | |
|---|---|---|---|
| 2,006,121 | A | 6/1935 | Tham |
| 2,007,071 | A | 7/1935 | Burns |
| 2,009,020 | A | 7/1935 | Flanagan |
| 2,010,051 | A | 8/1935 | Allyn et al. |
| 2,010,090 | A | 8/1935 | Chapelle |
| 2,011,042 | A | 8/1935 | DePhillips |
| 2,011,051 | A | 8/1935 | Hallquist |
| 2,312,018 | A | 2/1943 | Beckman |
| 2,828,107 | A | 3/1958 | Bobo |
| 2,865,602 | A | 12/1958 | Whittle |
| 3,066,735 | A | 12/1962 | Zingg |
| 3,116,800 | A | 1/1964 | Kammerer |
| 3,145,776 | A | 8/1964 | Pittman |
| 3,301,337 | A | 1/1967 | Vaughn et al. |
| 3,795,282 | A | 3/1974 | Oliver |
| 4,050,529 | A | 9/1977 | Tagirov et al. |
| 4,499,951 | A | 2/1985 | Vann |
| 4,518,041 | A | 5/1985 | Zublin |
| 4,638,873 | A | 1/1987 | Welborn |
| 4,815,540 | A | 3/1989 | Wallbillich, III |
| 4,967,841 | A | 11/1990 | Murray |
| 5,318,123 | A | 6/1994 | Venditto et al. |
| 5,499,687 | A | 3/1996 | Lee |
| 5,533,571 | A | 7/1996 | Surjaatmadja et al. |
| 5,564,500 | A | 10/1996 | Rogers et al. |
| 5,806,599 | A | 9/1998 | Hisaw et al. |
| 6,085,843 | A | 7/2000 | Edwards et al. |
| 6,189,618 | B1 | 2/2001 | Beeman et al. |
| 6,199,566 | B1 | 3/2001 | Gazewood |
| 6,378,612 | B1 | 4/2002 | Churchill |
| 6,439,866 | B1 | 8/2002 | Farkas et al. |
| 6,491,098 | B1 | 12/2002 | Dallas |
| 6,520,255 | B2 | 2/2003 | Tolman et al. |
| 6,564,868 | B1 | 5/2003 | Ferguson et al. |
| 6,568,469 | B2 * | 5/2003 | Ohmer ..... E21B 47/12 166/50 |
| 6,732,793 | B1 | 5/2004 | Lee |
| 7,195,067 | B2 | 3/2007 | Manke et al. |
| 7,357,182 | B2 | 4/2008 | Hunt et al. |
| 7,383,881 | B2 | 6/2008 | Telfer |
| 7,617,871 | B2 | 11/2009 | Surjaatmadja et al. |
| 7,673,673 | B2 | 3/2010 | Surjaatmadja et al. |
| 7,841,396 | B2 | 11/2010 | Surjaatmadja et al. |
| 7,963,331 | B2 | 6/2011 | Surjaatmadja et al. |
| 8,066,059 | B2 | 11/2011 | Erguson et al. |
| 3,132,625 | A1 | 3/2012 | Anderson |
| 8,210,250 | B2 | 7/2012 | Ferguson et al. |
| 8,230,912 | B1 | 7/2012 | Connell |
| 8,240,373 | B1 | 8/2012 | Britton et al. |
| 8,365,818 | B2 | 2/2013 | Schultz et al. |
| 8,381,817 | B2 | 2/2013 | Schultz et al. |
| 8,403,049 | B2 | 3/2013 | Ferguson et al. |
| 8,424,605 | B1 | 4/2013 | Schultz et al. |
| 8,439,117 | B2 | 5/2013 | Schultz et al. |
| 8,448,700 | B2 | 5/2013 | Connell et al. |
| 8,453,745 | B2 | 6/2013 | Schultz et al. |
| 8,517,105 | B2 | 8/2013 | Schultz et al. |
| 8,517,106 | B2 | 8/2013 | Schultz et al. |
| 8,517,107 | B2 | 8/2013 | Schultz et al. |
| 8,517,108 | B2 | 8/2013 | Schultz et al. |
| 3,550,176 | A1 | 10/2013 | Knobloch, Jr. et al. |
| 8,550,155 | B2 | 10/2013 | Schultz et al. |
| 8,657,007 | B1 | 2/2014 | Watson et al. |
| 8,783,338 | B1 | 7/2014 | Ferguson et al. |
| 8,905,125 | B1 | 12/2014 | Connell et al. |
| 9,194,181 | B2 | 11/2015 | Conell et al. |
| 9,212,522 | B2 | 12/2015 | Schultz et al. |
| 9,228,422 | B2 | 1/2016 | Watson et al. |
| 9,316,065 | B1 | 4/2016 | Schultz et al. |
| 9,353,597 | B2 | 5/2016 | Dotson et al. |
| 9,447,663 | B1 | 9/2016 | Connell et al. |
| 9,546,536 | B2 | 1/2017 | Schultz et al. |
| 9,777,558 | B1 | 10/2017 | Ferguson et al. |
| 9,915,107 | B1 | 3/2018 | Schultz et al. |
| 10,036,214 | B2 | 7/2018 | Britton |
| 2002/0092650 | A1 | 7/2002 | Tolman et al. |
| 2006/0027368 | A1 | 2/2006 | Manke et al. |
| 2006/0201675 | A1 | 9/2006 | Ferguson et al. |
| 2006/0219441 | A1 | 10/2006 | Telfer |
| 2006/0243455 | A1 | 11/2006 | Telfer et al. |
| 2006/0278393 | A1 | 12/2006 | Hunt et al. |
| 2007/0181313 | A1 | 8/2007 | Churchill |
| 2007/0284106 | A1 | 12/2007 | Kalman et al. |
| 2008/0135248 | A1 | 6/2008 | Talley et al. |
| 2008/0223587 | A1 | 9/2008 | Cherewyk |
| 2008/0283299 | A1 | 11/2008 | Surjaatmadja |
| 2009/0016900 | A1 | 1/2009 | Khomynets |
| 2009/0032255 | A1 | 2/2009 | Surjaatmadja et al. |
| 2009/0308588 | A1 | 12/2009 | Howell et al. |
| 2010/0044041 | A1 | 2/2010 | Smith et al. |
| 2010/0276204 | A1 | 11/2010 | Connell et al. |
| 2011/0114316 | A2 | 5/2011 | Ferguson et al. |
| 2011/0259602 | A1 | 10/2011 | Britton |
| 2011/0315403 | A1 | 12/2011 | Nard et al. |
| 2012/0024519 | A1 | 2/2012 | Ferguson et al. |
| 2012/0024538 | A1 | 2/2012 | Britton |
| 2012/0031615 | A1 | 2/2012 | Connell et al. |
| 2012/0118557 | A1 | 5/2012 | Ferguson et al. |
| 2012/0118577 | A1 | 5/2012 | Trahan et al. |
| 2012/0152550 | A1 | 6/2012 | East, Jr. |
| 2012/0167994 | A1 | 7/2012 | Schultz et al. |
| 2012/0227970 | A1 | 9/2012 | Schultz et al. |
| 2012/0291539 | A1 | 11/2012 | Schultz et al. |
| 2012/0292015 | A1 | 11/2012 | Schultz et al. |
| 2012/0292016 | A1 | 11/2012 | Schultz et al. |
| 2012/0292017 | A1 | 11/2012 | Schultz et al. |
| 2012/0292018 | A1 | 11/2012 | Schultz et al. |
| 2012/0292019 | A1 | 11/2012 | Schultz et al. |
| 2012/0292020 | A1 | 11/2012 | Schultz et al. |
| 2012/0292033 | A1 | 11/2012 | Schultz et al. |
| 2012/0292113 | A1 | 11/2012 | Schultz et al. |
| 2012/0292116 | A1 | 11/2012 | Schultz et al. |
| 2013/0000909 | A1 | 1/2013 | Schultz et al. |
| 2013/0192830 | A1 | 8/2013 | Watson et al. |
| 2013/0248192 | A1 | 9/2013 | Cook |
| 2014/0034312 | A1 | 2/2014 | Schultz et al. |
| 2014/0048247 | A1 | 2/2014 | Watson et al. |
| 2014/0060936 | A1 | 3/2014 | Connell et al. |
| 2014/0069648 | A1 | 3/2014 | Dotson et al. |
| 2014/0102705 | A1 | 4/2014 | Dotson |
| 2018/0252078 | A1 | 9/2018 | Schultz |

FOREIGN PATENT DOCUMENTS

| | | | |
|---|---|---|---|
| AU | 2012363052 | | 3/2017 |
| AU | 2013252728 | | 4/2017 |
| AU | 2013302992 | | 5/2017 |
| AU | 2013309107 | | 6/2017 |
| AU | 2013215487 | | 9/2017 |
| CA | 2833767 | | 2/2016 |
| CA | 2856689 | | 5/2016 |
| CA | 2807310 | | 6/2016 |
| CN | 2615322 | Y | 5/2004 |
| CN | 1877074 | A | 12/2006 |
| CN | 100999989 | A | 7/2007 |
| CN | 201574743 | U | 9/2010 |
| CN | 102022101 | A | 4/2011 |
| CN | 103547767 | A | 1/2014 |
| CN | 104011323 | | 8/2014 |
| CN | ZL201180038329.1 | | 10/2016 |
| CN | ZL201280063509 | | 10/2016 |
| CN | ZL201280012661.5 | | 2/2017 |
| CN | ZL201280023993.3 | | 2/2017 |
| EP | 0304988 | A1 | 3/1989 |
| EP | 0452126 | A2 | 10/1991 |
| EP | 2183462 | A1 | 5/2010 |
| MX | 2013001426 | A | 6/2013 |
| MX | 2014012982 | A | 3/2015 |
| MX | 332170 | | 8/2015 |
| MX | 339251 | | 5/2016 |
| MX | 346837 | | 3/2017 |
| MX | 348796 | | 6/2017 |
| MX | 348996 | | 7/2017 |
| MX | 349087 | | 7/2017 |

(56) References Cited

FOREIGN PATENT DOCUMENTS

| | | | |
|---|---|---|---|
| MX | 351461 | | 10/2017 |
| MX | 354084 | | 2/2018 |
| SU | 709803 | A1 | 1/1980 |
| WO | 2011136830 | A1 | 11/2011 |
| WO | 2012018700 | A2 | 2/2012 |
| WO | 2012082514 | A2 | 6/2012 |
| WO | 2012122141 | A1 | 9/2012 |
| WO | 2012158575 | A2 | 11/2012 |
| WO | 2013101333 | A2 | 7/2013 |
| WO | 2013116094 | A2 | 8/2013 |
| WO | 2014028254 | A2 | 2/2014 |
| WO | 2014035901 | A2 | 3/2014 |
| WO | 2017025838 | | 2/2017 |

* cited by examiner

ABRASIVE PERFORATOR WITH FLUID BYPASS

FIELD OF THE INVENTION

The present invention relates generally to downhole tools and, more particularly but without limitation, to abrasive perforating tools.

DETAILED DESCRIPTION OF THE PREFERRED EMBODIMENT(S)

The present invention comprises an abrasive perforating tool with three operating positions created by upper and lower valve sleeves that shift sequentially from a first or nondeployed position to a second, deployed position. In a first "flow through" position, the two nondeployed valve sleeves create a first flow path directing abrasive fluid entering the housing straight through the main bore to the outlet end of the tool. In a second "perforating" position, the first or lower sleeve is shifted to the deployed position to block flow out the end of the tool and to redirect flow to the nozzles in the side of the housing. Finally, the upper valve sleeve is shifted to the deployed position to form the third or "bypass" position, in which flow is diverted through a bypass channel to reestablish flow out the bottom of the tool.

In the preferred embodiment, each of the valve sleeves is telescopically supported in a shear sleeve that is fixed to the housing. The valve sleeves and their respective shear sleeves are arranged axially in the tool housing, that is, the upper and lower valve sleeves are arranged end-to-end, rather than concentrically or telescopically. Each of the two valve sleeves is held by shear pins, and the shear pins for each valve sleeve are independent. That is, when increased fluid pressure is applied to break the shear pins for the first valve sleeve, no pressure is exerted on the shear pins holding the second sleeve in its nondeployed position. This reduces the likelihood that the shear pins on the second sleeve will fail and cause premature deployment of the second sleeve.

In the preferred practice of the invention, the valve sleeves are ball-actuated. Thus, each valve sleeve is provided with a ball seat in its central bore. Most preferably, the ball seat in the first sleeve is at or near the lower end of the sleeve. This improves stability of the sleeve as the fluid pressure acts on it making it less likely that the sleeve will deform or buckle, which in turn may lead to failure of the fluid seals.

The components of the inventive tool are configured so that when the tool shifts to the second, perforating position, an efficient flow is created to minimize resistance allowing for higher fluid pressures for perforating. More specifically, in this position, fluid passes from the inlet through the main bore of the housing and the central bores of the valve sleeves directly out the nozzles. Both valve sleeves are sealingly mounted inside the tool housing; no flow is diverted around either sleeve in the perforating position. This configuration also allows the thickness of the housing's sidewall to be maximized in turn permitting the use of longer nozzles that are more resistant to erosion from the abrasive fluid. Still further, the thicker sidewall allows for the use of larger O-rings providing a stronger seal.

Figure 1:
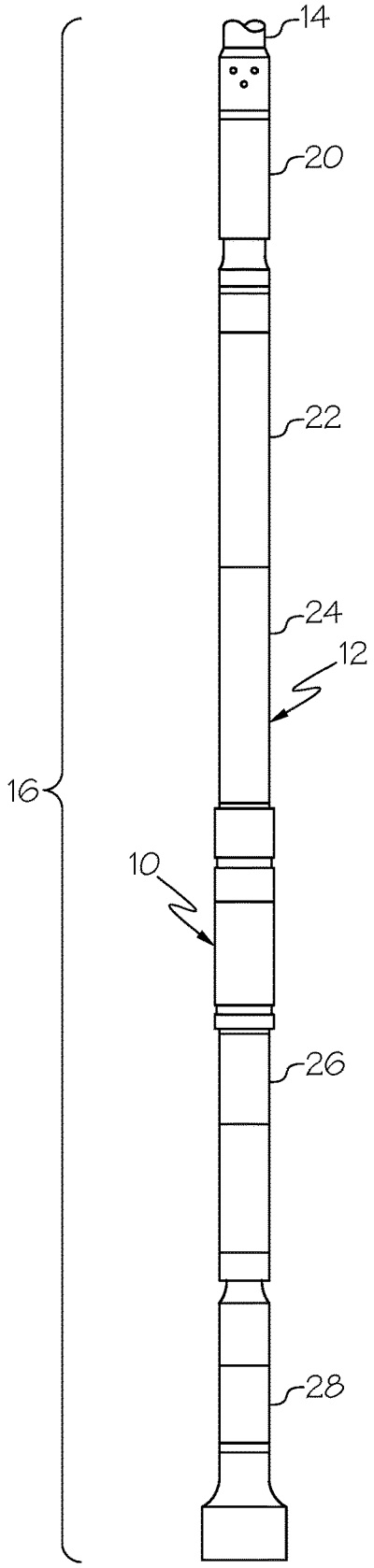
FIG. 1 is a fragmented side elevational view of a drill string comprising a bottom hole assembly including an abrasive perforator tool made in accordance with the present invention.

Turning now to the drawings in general and to FIG. 1 in particular there is shown therein an abrasive perforating tool designated generally by the reference number 10. The tool 10 is shown as one of several components in a bottom hole assembly 12 suspended at the end of a conduit 14, such as coiled tubing. As used herein, "bottom hole assembly" or simply "BHA," refers to the combination of tools supported on the end of the well conduit 14. As used herein, "drill string" refers to the column or string of drill pipe, coil tubing, wireline, or other well conduit 14, combined with attached BHA 12 and is designated herein generally by the reference number 16.

The BHA 12 may include a variety of tools. In the example shown, the BHA 12 includes a coiled tubing connector 20, a dual back pressure valve 22, a hydraulic disconnect 24, the inventive bypass perforator tool 10, a motor 26, and a mill 28 on the end.

Figure 2:
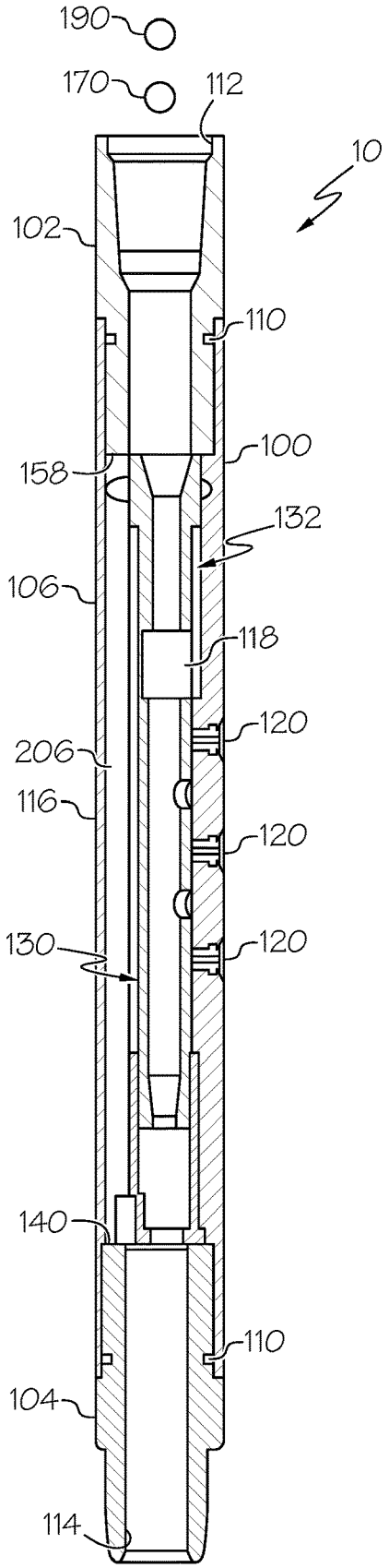
FIG. 2 shows a longitudinal sectional view of the abrasive perforator tool.

With reference now to FIG. 2, a first preferred embodiment of the tool 10 will be described. The tool 10 comprises a tubular tool housing designated generally at 100. Preferably the housing 100 is made up of a top sub 102, a bottom sub 104, and a housing body 106, that are threadedly interconnected with seals, such as O-rings, designated generally at 110 to provide a fluid tight passage therethrough. The top sub 102 defines an inlet 112, the bottom sub 104 defines an outlet 114, and the body 106 comprises a sidewall 116 that defines a main bore 118 extending between the inlet and the outlet.

At least one and preferably several nozzles 120 are supported in openings 122 (FIG. 3) in the sidewall 116 of the housing 100 that are fluidly continuous with the main bore 118. These nozzles may take many forms. The nozzles may be commercially available carbide nozzles that are threaded into nozzle bores. The nozzles may be provided with abrasion resistant plates or collars (not shown).

Figure 3:
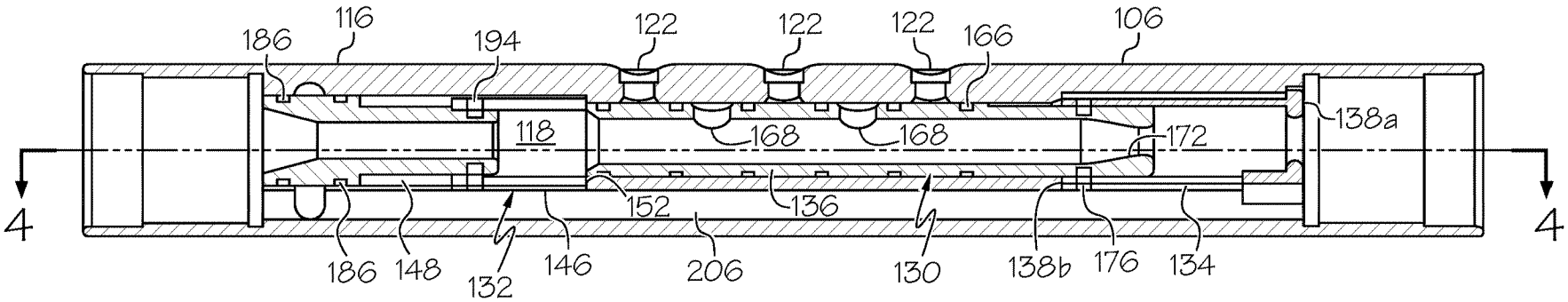
FIG. 3 shows an enlarged, longitudinal sectional view of the abrasive perforator tool with the top and bottom sub omitted.
Figure 4:
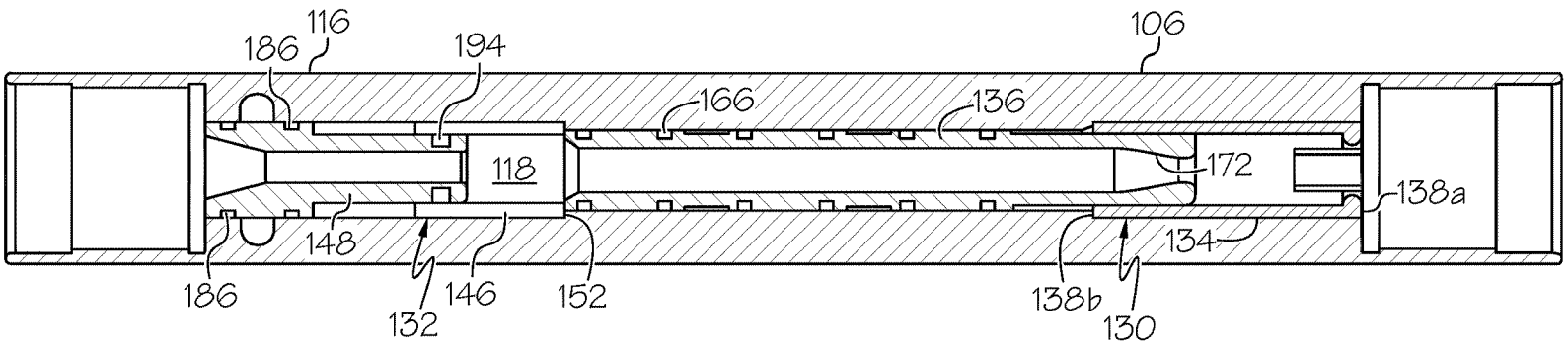
FIG. 4 shows a longitudinal sectional view of the abrasive perforator tool with the top and bottom sub omitted taken along line 4-4 of FIG. 3.

Referring now also to FIGS. 3 and 4, a valve assembly is supported inside the central bore 118 to control the flow of fluid through the tool 10 in one of three operating positions. The valve assembly comprises a first valve assembly 130 and a second valve assembly 132.

Figure 10A:
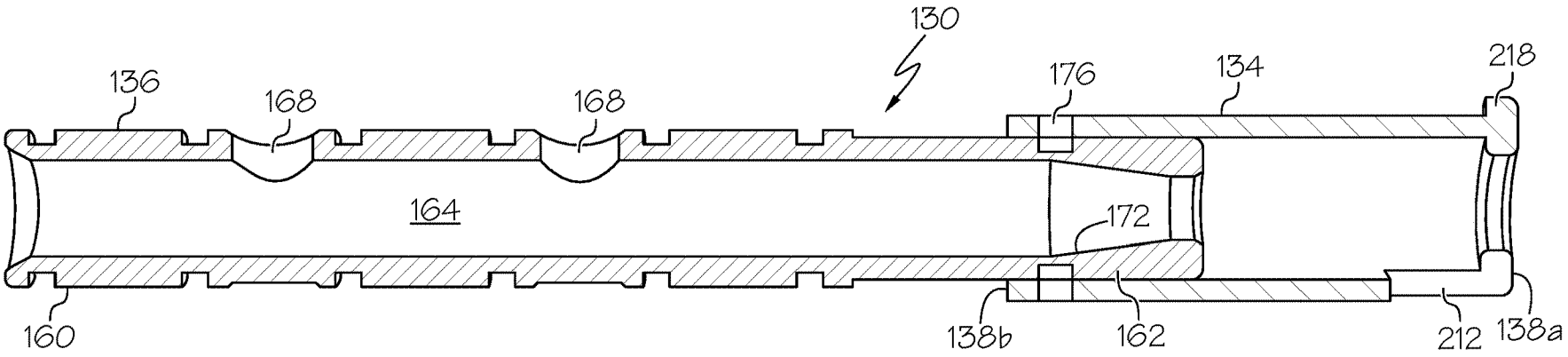
FIG. 10A shows the lower or first sleeve assembly in the first or undeployed position.
Figure 10B:
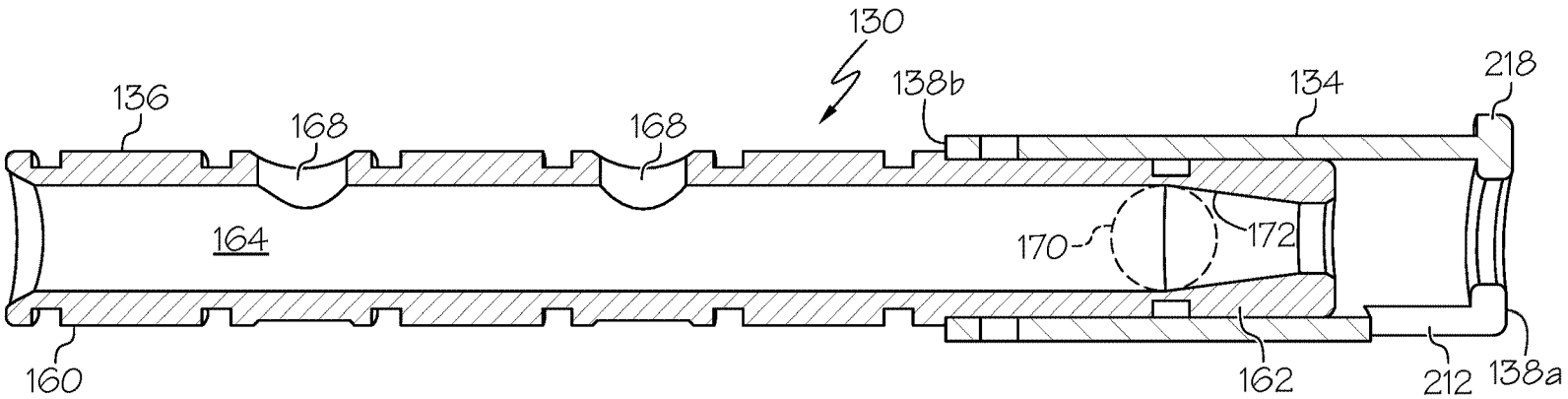
FIG. 10B shows the lower or first sleeve assembly in the second, deployed position.

The first valve assembly 130 comprises a first shear sleeve or retainer sleeve 134 and a first valve sleeve 136, also seen in FIGS. 10A and 10B. The first shear sleeve 134 is mounted at the lower end of the main bore 118 of the housing body 106 and is fixed relative to the housing 100. Although this may be achieved in different ways, in the example shown, the first shear sleeve 134 is configured so that its lowermost end face 138*a* (FIGS. 3 & 4) abuts the upper end face 140 (FIG. 2) of the bottom sub 104 in the assembled tool and its uppermost end face 138*b* (FIGS. 10A & B) abuts a shoulder 142 (FIGS. 5-7) formed in the inner diameter of the main bore 118. Thus, once bottom sub 104 is attached to the housing body 106, the first shear sleeve 134 is fixed relative to the housing 100.

Figure 11A:
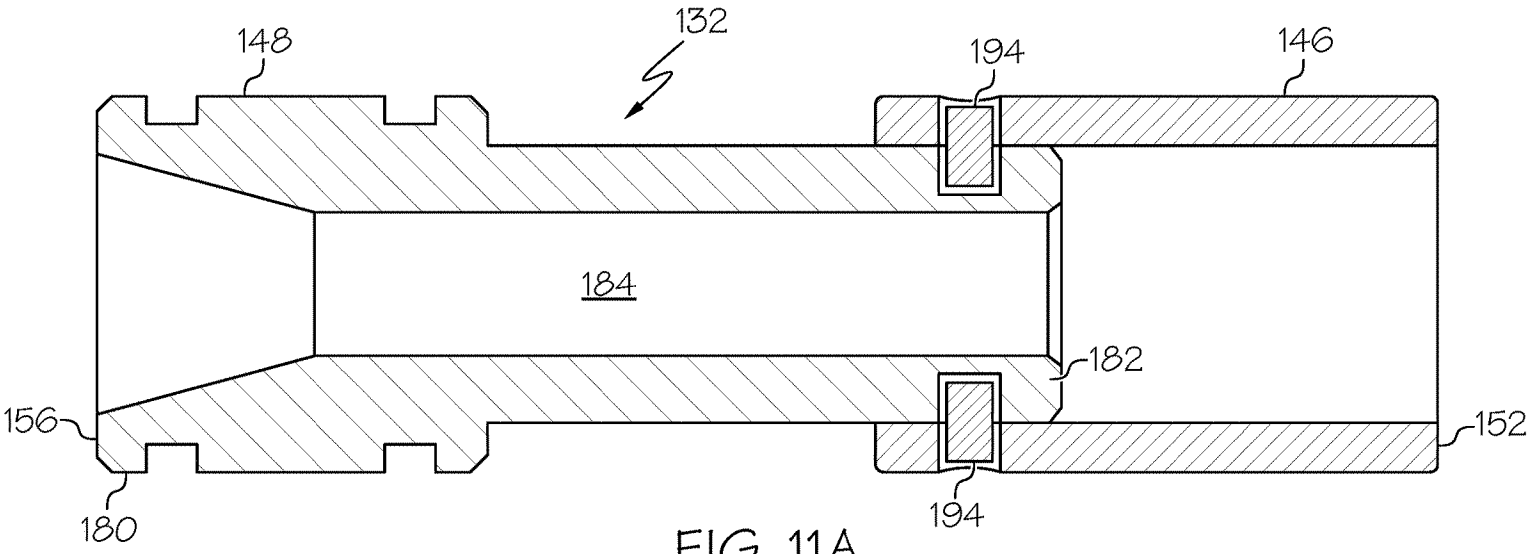
FIG. 11A shows the upper or second sleeve assembly in the first or undeployed position.
Figure 11B:
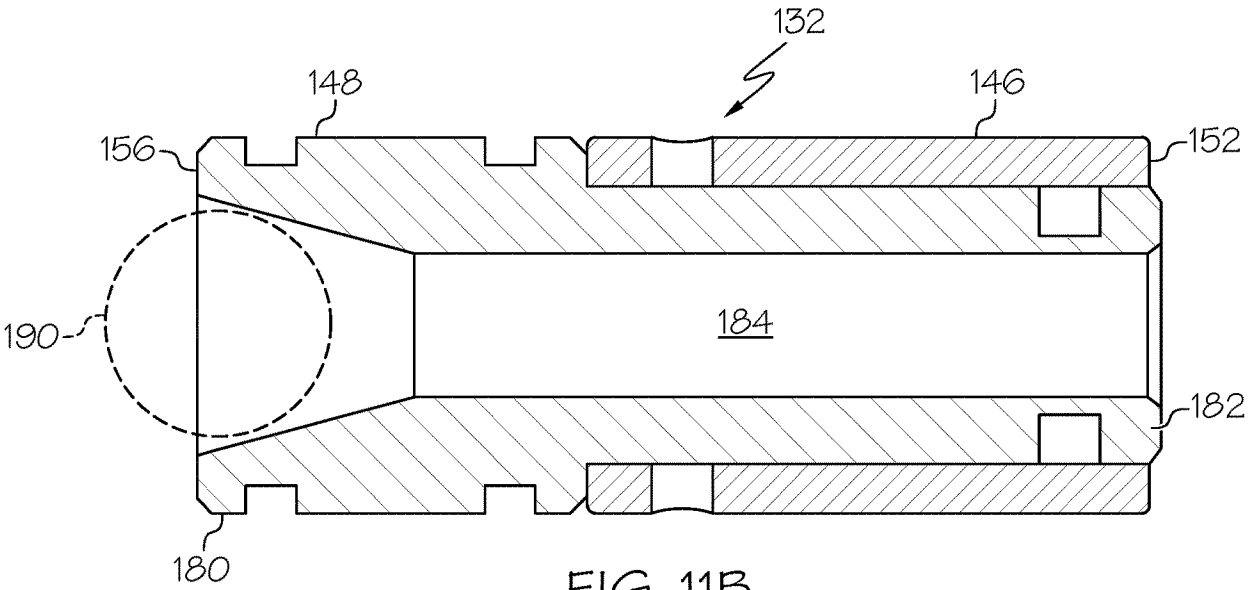
FIG. 11B shows the upper or second sleeve assembly in the second, deployed position.

The second valve assembly 132 comprises a second shear or retainer sleeve 146 and a second valve sleeve 148, seen also in FIGS. 11A and 11B. The second shear sleeve 146 is mounted near the upper end of the main bore 118 of the housing body 106 and is fixed relative to the housing 100. Although this may be achieved in different ways, in the example shown, the second shear sleeve 146 is configured so that its lowermost end face 152 (FIGS. 3&4) meets a shoulder 154 (FIGS. 5-7) formed in the inner diameter of the main bore 118 in the assembled tool 10 (FIG. 2). The uppermost end face 156 (FIGS. 11A&B) of the second valve sleeve 148 abuts the lower end face 158 (FIG. 2) of the top sub 102 when the tool 10 is assembled.

With continuing reference to FIGS. 2-7 and 10A & B, the first valve sleeve 136 of the first valve assembly 130 has an upper end 160 and a lower end 162 fluidly connected by a central bore 164. The lower end 162 is telescopically received in the first shear sleeve 134 for sliding movement from a non-deployed position, seen in FIGS. 3, 4 and 10A, to a deployed position, shown in FIG. 10B.

Preferably, the first valve sleeve 136 is sealingly mounted inside the tool housing 100 so that there is no fluid flow between the sleeve 136 and the inner diameter of the housing's main bore 118. This fluid-tight seal may be accomplished with one or more seals, such as O-rings designated generally at 166 (FIGS. 3 & 4). Depending on the length of the first valve sleeve 136, the sleeve may include ports designated generally at 168 that are sized and positioned to align with the openings 122 in the housing sidewall 116.

In the exemplary embodiment, movement of the first valve sleeve 136 from the non-deployed position to the deployed position is ball-actuated, that is, the shift is initiated by dropping a ball, such as a first ball 170 (FIG. 2) down the drill string 16 in a known manner. To that end, the first valve sleeve 136 is provided with a ball seat 172, and preferably the ball seat is located near the lower end 162 of the sleeve. In alternate embodiments, actuators other than balls may be employed to initiate the movement of the first valve sleeve from the non-deployed to the deployed position.

The first valve sleeve 136 is releasably secured to the first retainer sleeve 134 for movement from the non-deployed position to the deployed position. Although the mechanism of this releasable attachment may vary, one exemplary mechanism is a shear pin. Thus, in the in preferred embodiment, at least one shear pin 176 (FIGS. 3 & 10A) releasably secures the first valve sleeve 136 in the non-deployed position until the rising fluid pressure created by the first ball 170 (FIGS. 2 & 10B) breaks the pin 176 allowing the sleeve to shift downwardly to the deployed position. In many applications of the present invention, the first valve sleeve 136 will be elongated, typically substantially longer than the second (upper) valve sleeve 148. Having the ball seat near the lower end of the sleeve prevents the pressure on the sleeve from causing it to buckle.

With reference again to FIGS. 2-7 and 11A&B, the second valve sleeve 148 of the second valve assembly 132 has an upper end 180 and a lower end 182 fluidly connected by a central bore 184. The lower end 182 is telescopically received in the second shear sleeve 146 for sliding movement from a non-deployed position, seen in FIGS. 3, 4 and 11A, to a deployed position, shown in FIG. 11B. Preferably, the second valve sleeve 148 is sealingly mounted inside the tool housing 100 so that there is no fluid flow between the sleeve and the inner diameter of the housing's main bore 118. This fluid-tight seal may be accomplished with one or more seals, such as O-rings designated generally at 186 (FIGS. 3&4).

In the exemplary embodiment, movement of the second valve sleeve 148 from the non-deployed position to the deployed position is ball-actuated, that is, the shift is initiated by dropping a ball, such as the second ball 190 (FIG. 2) down the drill string 16 in a known manner. To that end, the second valve sleeve 148 is provided with a ball seat 192, and preferably the ball seat is located near the upper end 180 of the sleeve.

The second valve sleeve 148 is releasably secured to the second retainer sleeve 146 for movement from the non-deployed position to the deployed position. Although the mechanism of this releasable attachment may vary, one exemplary mechanism is a shear pin. Thus, in the preferred embodiment, at least one shear pin 194 (FIGS. 3 & 11A) releasably secures the second valve sleeve 148 in the non-deployed position until the rising fluid pressure created by the second ball 190 (FIGS. 2 & 11B) breaks the pin 194 allowing the sleeve to shift downwardly to the deployed position (FIG. 11B). In alternate embodiments, actuators other than balls may be employed to initiate the movement of the second valve sleeve from the non-deployed to the deployed position.

Now it will be appreciated that the first and second valve assemblies 130 and 132, and more particularly, the first and second valve sleeves 136 and 148, are arranged end-to-end in the housing body 106. In the initial operating position, when both sleeves are in the non-deployed position, the upper end 160 of the first (lower) sleeve 136 is spaced a distance axially below the lower end of the second (upper) valve sleeve 148. Thus, the main bores 164 and 184 of the valve sleeves 136 and 138 are co-axial and form a continuous flow path with the main bore 118 of the housing 100.

Figure 5:
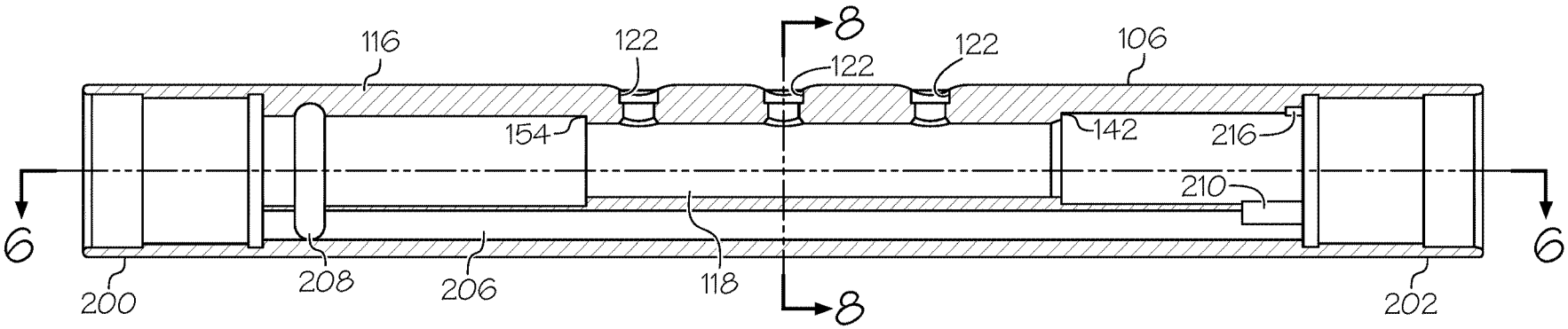
FIG. 5 is a longitudinal sectional view of the housing.
Figure 6:
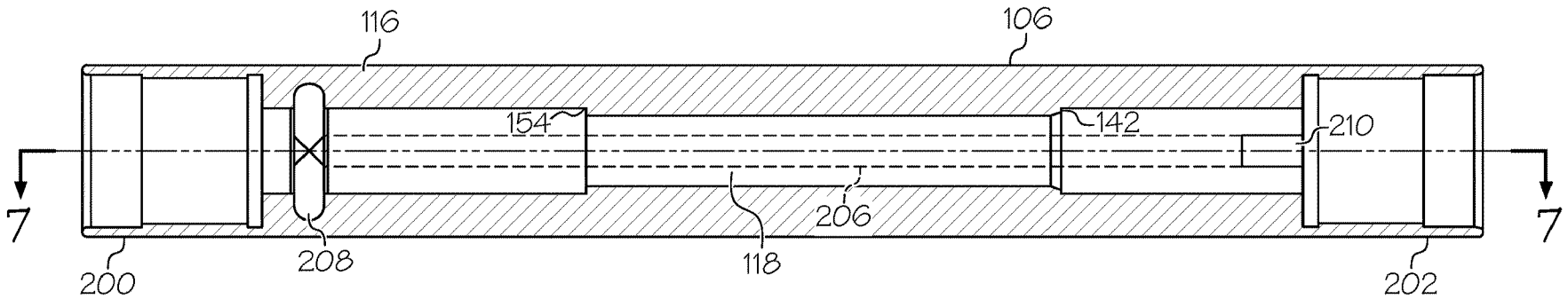
FIG. 6 is a longitudinal sectional view of the housing taken along line 6-6 of FIG. 5.
Figure 7:
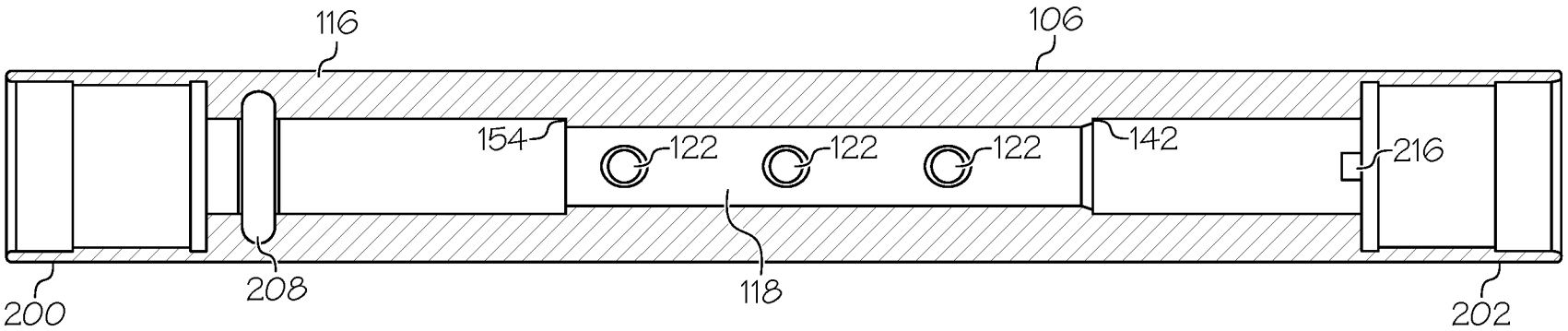
FIG. 7 is a longitudinal sectional view of the housing taken along line 7-7 of FIG. 6.
Figure 8:
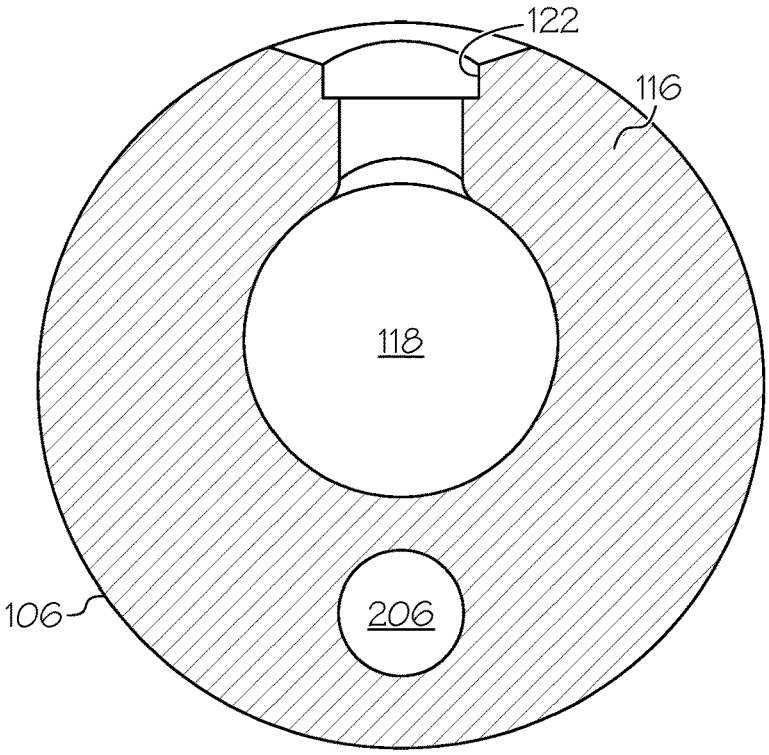
FIG. 8 is a cross-sectional view of the housing taken along line 8-8 of FIG. 5.
Figure 9:
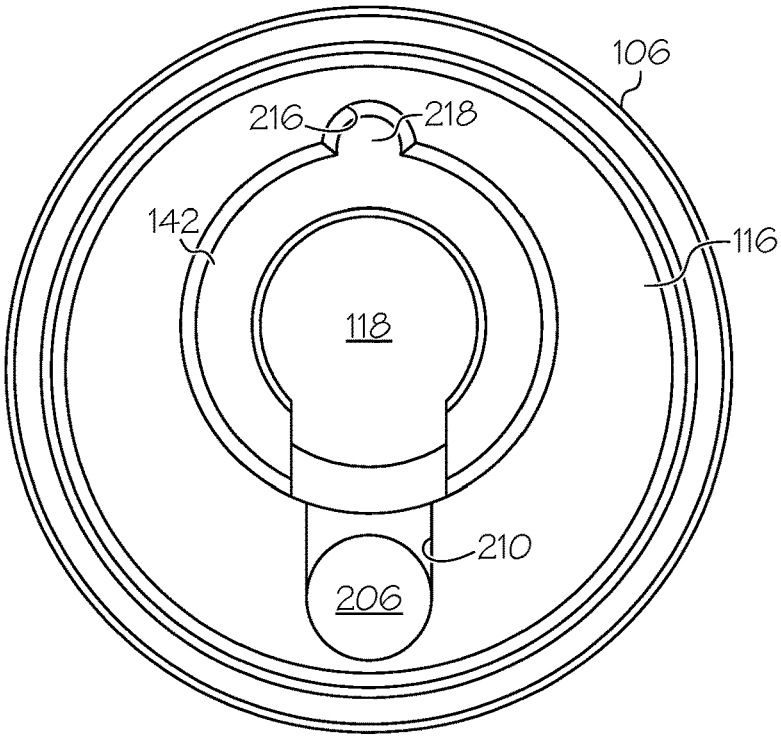
FIG. 9 is a lower end view of the housing shown in FIG. 5.

Referring still to FIGS. 5-7 and now also to FIGS. 8 and 9, the preferred structure of the housing body 106 will be explained in more detail. As shown, the main bore 118 forms a continuous flow path through the housing body from the inlet end 200 to the outlet end 202. As previously described, the central bores 164 and 184 of the first and second valve sleeves 136 and 148, respectively, are disposed in this flow path. Thus, in the initial "flow through" position, fluid flows directly through both sleeves.

An alternate or bypass flow path is provided through a bypass channel 206, which preferably is formed in the sidewall 116 of the housing body 106. In the embodiment shown, only a single bypass channel 206 is used. However, two or more such channels may be formed in the tool. As is shown in FIGS. 5-7 and also FIGS. 8 and 9, in the illustrative embodiment, the bypass channel 206 runs parallel to the main bore 118 through the housing body 106, and both the main bore and the bypass channels are slightly offset from the longitudinal axis of the housing body. The bypass flow path may be formed using a gun drill or using other known techniques, such as using a "tube inside a tube" configuration for the housing, that is, by forming the housing out of closely fitting inner and outer tubular members, and forming longitudinal grooves in the outer diameter of the inner tubular member or in the inner diameter of the outer tubular member or both.

A bypass inlet 208 is formed near the upper end 200 of the housing body 106 and is continuous with the housing inlet 112 (FIG. 2) in the assembled tool 10. In the exemplary tool 10, the bypass inlet 208 is a circumferential groove formed in the inner diameter of the main bore 118 and is positioned so that when the second valve sleeve 148 is in the non-deployed position, as seen in FIGS. 3 and 4, the bypass inlet 208 is sealed off from fluid entering the housing 100. To that end, the O-rings 186 may be positioned above and below the inlet groove 208.

Figure 12:
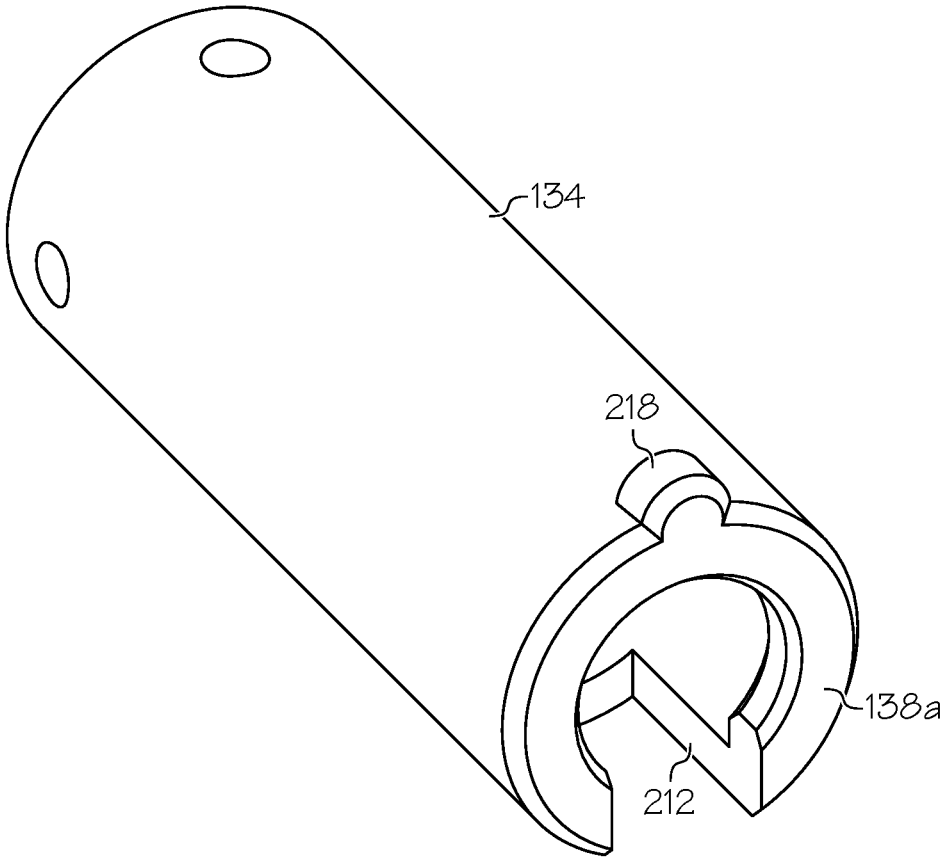
FIG. 12 shows a bottom perspective view of the lower shear sleeve.

A bypass outlet 210 is formed near the lower end 202 of the housing body 106 and is also continuous with the housing outlet 114 (FIG. 2) in the assembled tool 10. The bypass outlet 210 may take the form of a notch or recess formed at the lower end of the housing body 106 to fluidly connect the main bore 118 with the end of the bypass channel 206. A corresponding notch 212 may be formed in the lower end of the first shear sleeve 134, as best seen in the perspective view of the sleeve provided in FIG. 12. To ensure that the notch 212 in the shear sleeve 134 remains aligned with the outlet recess 210 in the housing sidewall 116, the sidewall may be provided with a smaller notch 216 opposite the recess 210 to receive an anti-rotation rib 218 formed on the outer edge of the lower end of the sleeve.

Figure 13A:
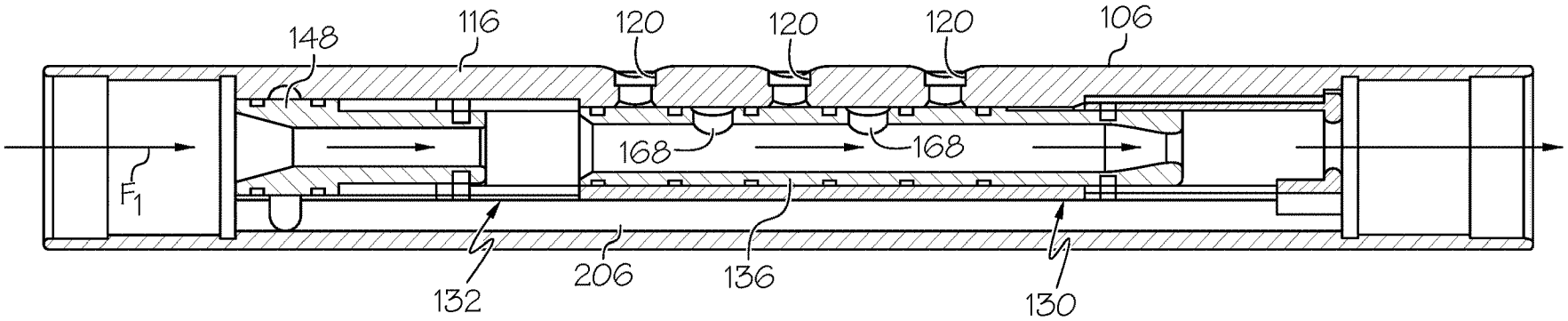
FIGS. 13A-13C illustrate the three operating positions of the tool with arrows illustrating the three flow paths.
Figure 13B:
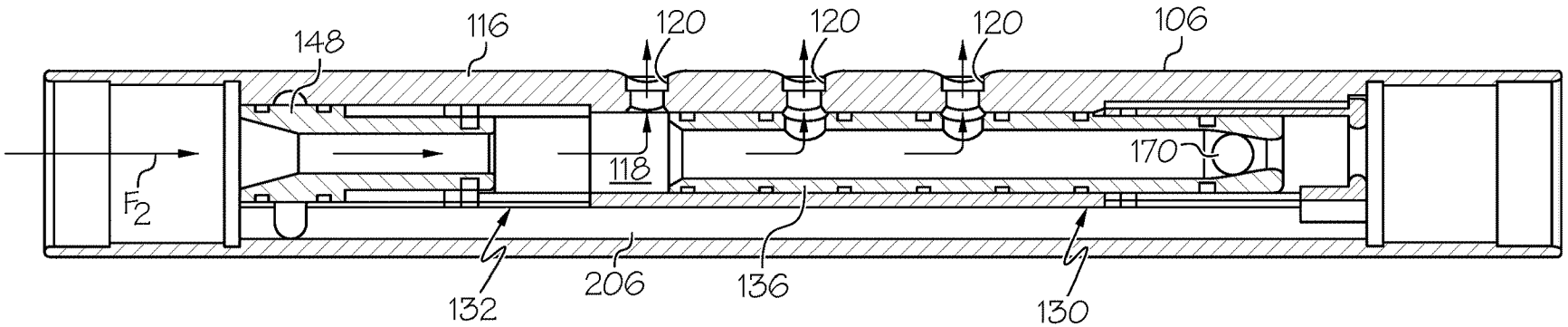
Figure 13C:
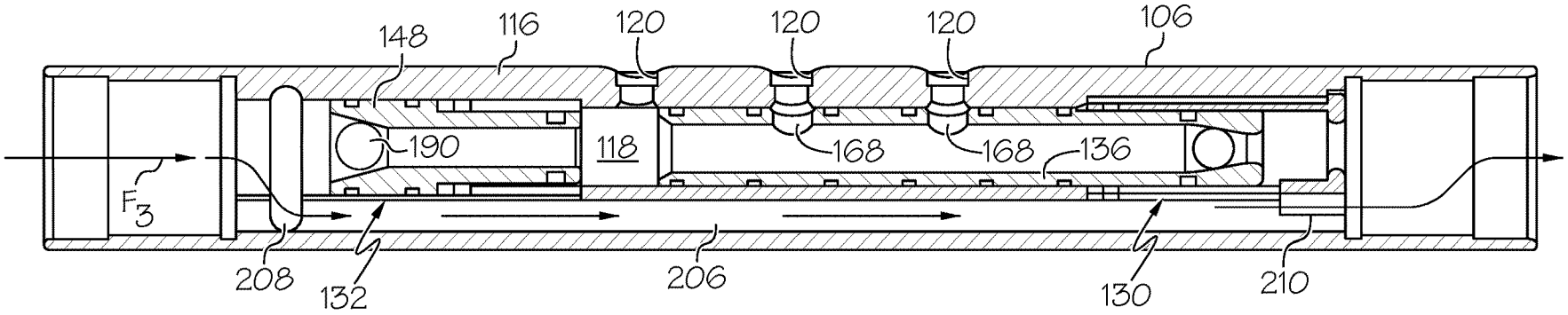

With reference now to FIGS. 13A-13C, the operation of the tool will be explained. The first operating position, of the "flow through" position is shown in FIG. 13A. The first and second valve sleeves 136 and 148 both are in the non-deployed position. The first valve sleeve 136 blocks flow to the nozzles 120 in the housing sidewall 116, and flow through the bypass channel 206 is blocked by the upper end 180 of the second valve sleeve 148. This forms a first flow path $F_1$ directing abrasive fluid entering the housing inlet to the housing outlet.

As shown in FIG. 13B, dropping the first ball 170 shifts the first valve sleeve 136 to the deployed position, while the second valve sleeve 148 remains in the non-deployed position. In this second position, the nozzles in the housing sidewall 116 are either above the sleeve 136 or aligned with the ports 168 in the sleeve, so flow entering the main bore 118 is directed out the nozzles for perforating forming the second flow path $F_2$.

Turning to FIG. 13C, the third or bypass position of the tool is illustrated. The second ball 190 has been dropped, shifting the second valve sleeve 148 to the deployed position, opening the bypass inlet 208. Thus, flow through the nozzles 120 and the main bore 118 is blocked and flow is diverted through the bypass channel 206 and out the housing outlet forming the third flow path $F_3$.

Now it will be apparent that the abrasive perforating tool of the present invention provides many advantages. One advantage is the ability to regain high-rate fluid flow through the tool after perforating. This allows a thorough cleanout of the well, which is difficult to obtain using current technology. Another advantage is the ability to operate a motor or other fluid driven tool below the perforating tool after completing the perforating operation but without withdrawing the tool string.

Thus, the invention further comprises a method for treating a well. The method comprises first running a tool string down the well. The tool string comprises a conduit and a bottom hole assembly that includes an abrasive perforating tool. Once the bottom hole assembly has been positioned at the desired depth, fluid is passed through the tool string without perforating. The above-described perforating tool allows pressurized fluid flow prior to perforating to carry out other well procedures, or to operate other fluid-driven tool beneath the perforator in the bottom hole assembly, or both.

At the desired point in the well treatment process, that is, after passing fluid through the tool string without perforating, the well is abrasively perforated without withdrawing the tool string. This may be accomplished by dropping the first ball in the preferred perforating tool to divert fluid to the nozzles and changing the fluid to comprise an abrasive fluid.

After the perforating process is completed, the abrasive fluid is stopped and another suitable well treatment fluid continues to be passed through the tool string again after perforating and without withdrawing the tool string. This is accomplished by dropping the second ball in the above-described perforator to bypass the nozzles and resume flowing fluid through the outlet of the tool. Again, the above-described perforating tool allows pressurized fluid flow after perforating to carry out additional well procedures, or to operate other fluid driven tools beneath the perforator in the bottom hole assembly, or both.

As used herein, the terms "up," "upward," "upper," and "uphole," and similar terms refer only generally to the end of the drill string nearest the surface. Similarly, "down," "downward," "lower," and "downhole" refer only generally to the end of the drill string furthest from the well head. These terms are not limited to strictly vertical dimensions. Indeed, many applications for the tool of the present invention include non-vertical well applications.

The contents of U.S. Pat. No. 8,066,059, entitled "Methods and Devices for One Trip Plugging and Perforating of Oil and Gas Wells," issued on Nov. 29, 2011, and U.S. Pat. No. 8,448,700, entitled "Abrasive Perforator with Fluid Bypass," issued on May 28, 2013, are incorporated herein by reference.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present invention have been described in the drawings and accompanying text, the description is illustrative only. Changes may be made in the details, especially in matters of shape, size, and arrangement of the parts, within the principles of the invention to the full extent indicated by the broad meaning of the terms. The description and drawings of the specific embodiment herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. An abrasive perforator tool for use with abrasive fluid, the tool comprising:

a tubular tool housing comprising an inlet and an outlet and a sidewall extending therebetween, the housing defining a main bore extending between the inlet and the outlet, and the housing further having a bypass inlet continuous with the housing inlet, a bypass outlet continuous with the housing outlet, and at least one bypass channel fluidly connecting the bypass inlet and the bypass outlet;

at least one nozzle in the housing sidewall fluidly continuous with the main bore;

a first ball-actuated valve sleeve mounted inside the tool housing for sliding movement from a non-deployed position to a deployed position, the first valve sleeve having an upper end and a lower end fluidly connected by a central bore, and further having a ball seat in the lower end of the central bore, wherein the first valve sleeve is releasably secured against movement relative to the tool housing when the first valve sleeve is in the non-deployed position;

a second ball-actuated valve sleeve mounted inside the tool housing for sliding movement from a non-deployed position to a deployed position after the first valve sleeve has been deployed, the second valve sleeve having an upper end and a lower end fluidly connected by a central bore, and further having a ball seat in the central bore, wherein the second valve sleeve is releasably secured against movement relative to the tool housing when the second valve sleeve is in the non-deployed position;

wherein, when the first and second valve sleeves both are in the non-deployed position, flow through the at least one nozzle in the housing sidewall and through the bypass channel is prevented thereby forming a first flow path directing abrasive fluid entering the housing inlet to the housing outlet;

wherein, when the first valve sleeve is in the deployed position and the second valve sleeve still is in the non-deployed position, flow through the bypass channel and the housing outlet is blocked and flow through the at least one nozzle is permitted thereby forming a second flow path directing fluid entering the housing inlet through the at least one nozzle; and wherein, when the first and second valve sleeves both are in the deployed position, flow through at least one nozzle is blocked and flow is permitted through the bypass channel forming a third flow path directing fluid entering the housing inlet through the bypass channel and out the housing outlet.

2. The abrasive perforator tool of claim 1 wherein the first and second valve sleeves are arranged end-to-end in the housing.

3. The abrasive perforator tool of claim 2 further comprising a first retainer sleeve mounted at the lower end of the main bore, wherein the lower end of the first valve sleeve is telescopically received in the first retainer sleeve, and wherein the first valve sleeve is releasably secured to the first retainer sleeve.

4. The abrasive perforator tool of claim 3 further comprising a second retainer sleeve mounted at the upper end of the main bore, wherein the lower end of the second valve sleeve is telescopically received in the second retainer sleeve, and wherein the second valve sleeve is releasably secured to the second retainer sleeve.

5. The abrasive perforator tool of claim 4 wherein the first valve sleeve is sealingly mounted in the housing.

6. The abrasive perforator tool of claim 5 wherein the second valve sleeve is sealingly mounted in the housing.

7. The abrasive perforator tool of claim 1 further comprising a first retainer sleeve mounted at the lower end of the main bore, wherein the lower end of the first valve sleeve is telescopically received in the first retainer sleeve, and wherein the first valve sleeve is releasably secured to the first retainer sleeve.

8. The abrasive perforator tool of claim 7 further comprising a second retainer sleeve mounted at the upper end of the main bore, wherein the lower end of the second valve sleeve is telescopically received in the second retainer sleeve, and wherein the second valve sleeve is releasably secured to the second retainer sleeve.

9. The abrasive perforator tool of claim 8 wherein the first valve sleeve is sealingly mounted in the housing.

10. The abrasive perforator tool of claim 9 wherein the second valve sleeve is sealingly mounted in the housing.

11. The abrasive perforator tool of claim 1 wherein the first valve sleeve is sealingly mounted in the housing.

12. The abrasive perforator tool of claim 11 wherein the second valve sleeve is sealingly mounted in the housing.

13. The abrasive perforator tool of claim 1 wherein the at least one bypass channel is formed in the sidewall of the housing.

14. The abrasive perforator tool of claim 13 wherein the at least one bypass channel comprises a single bypass channel.

15. The abrasive perforator tool of claim 14 wherein the tubular tool housing has a longitudinal axis and wherein the main bore of the housing is offset from the longitudinal axis of the housing.

16. A bottom hole assembly comprising the abrasive perforator tool of claim 1.

17. A tool string comprising the bottom hole assembly of claim 16.

18. An abrasive perforator tool for use with abrasive fluid, the tool comprising:

a tubular tool housing comprising an inlet and an outlet and a sidewall extending therebetween, the housing defining a main bore extending between the inlet and the outlet, and the housing further having a bypass inlet continuous with the housing inlet, a bypass outlet continuous with the housing outlet, and at least one bypass channel fluidly connecting the bypass inlet and the bypass outlet;

at least one nozzle in the housing sidewall fluidly continuous with the main bore;

a first valve sleeve sealingly mounted inside the tool housing for sliding movement from a non-deployed position to a deployed position, the first valve sleeve having an upper end and a lower end fluidly connected by a central bore, wherein the first valve sleeve is releasably secured against movement relative to the tool housing when the first valve sleeve is in the non-deployed position;

a second valve sleeve sealingly mounted inside the tool housing for sliding movement from a non-deployed position to a deployed position after the first valve sleeve has been deployed, the second valve sleeve having an upper end and a lower end fluidly connected by a central bore, wherein the second valve sleeve is releasably secured against movement relative to the tool housing when the second valve sleeve is in the non-deployed position;

wherein, when the first and second valve sleeves both are in the non-deployed position, flow through the at least one nozzle in the housing sidewall and through the bypass channel is prevented thereby forming a first flow path directing abrasive fluid entering the housing inlet to the housing outlet;

wherein, when the first valve sleeve is in the deployed position and the second valve sleeve still is in the non-deployed position, flow through the bypass channel and the housing outlet is blocked and flow through the at least one nozzle is permitted thereby forming a second flow path directing fluid entering the housing inlet through the at least one nozzle; and wherein, when the first and second valve sleeves both are in the deployed position, flow through at least one nozzle is blocked and flow is permitted through the bypass channel forming a third flow path directing fluid entering the housing inlet through the bypass channel and out the housing outlet.

19. The abrasive perforator tool of claim 18 further comprising a first retainer sleeve mounted at the lower end of the main bore, wherein the lower end of the first valve sleeve is telescopically received in the first retainer sleeve, and wherein the first valve sleeve is releasably secured to first retainer sleeve.

20. The abrasive perforator tool of claim 19 further comprising a second retainer sleeve mounted at the upper end of the main bore, wherein the lower end of the second valve sleeve is telescopically received in the second retainer sleeve, and wherein the second valve sleeve is releasably secured to the second retainer sleeve.

21. The abrasive perforator tool of claim 20 wherein the first and second valve sleeves are arranged end-to-end in the housing.

22. The abrasive perforator tool of claim 18 wherein the first and second valve sleeves are arranged end-to-end in the housing.

23. A bottom hole assembly comprising the abrasive perforator tool of claim 18.

24. A tool string comprising the bottom hole assembly of claim 23.

25. An abrasive perforator tool for use with abrasive fluid, the tool comprising:

a tubular tool housing comprising an inlet and an outlet and a sidewall extending therebetween, the housing defining a main bore extending between the inlet and the outlet, and the housing further having a bypass inlet continuous with the housing inlet, a bypass outlet continuous with the housing outlet, and at least one bypass channel fluidly connecting the bypass inlet and the bypass outlet;

at least one nozzle in the housing sidewall fluidly continuous with the main bore;

a first retainer sleeve mounted at the lower end of the main bore;

a first valve sleeve having an upper end and a lower end fluidly connected by a central bore, wherein the lower end of the first valve sleeve is telescopically received in the first retainer sleeve for sliding movement from a non-deployed position to a deployed position, wherein the first valve sleeve is releasably secured to the first retainer sleeve;

a second retainer sleeve mounted at the upper end of the main bore;

a second valve sleeve having an upper end and a lower end fluidly connected by a central bore, wherein the lower end of the second valve sleeve is telescopically received in the second retainer sleeve for sliding movement from a non-deployed position to a deployed position after the first valve sleeve has been deployed, wherein the second valve sleeve is releasably secured to the second retainer sleeve;

wherein, when the first and second valve sleeves both are in the non-deployed position, flow through the at least one nozzle in the housing sidewall and through the bypass channel is prevented thereby forming a first flow path directing abrasive fluid entering the housing inlet to the housing outlet;

wherein, when the first valve sleeve is in the deployed position and the second valve sleeve still is in the non-deployed position, flow through the bypass channel and the housing outlet is blocked and flow through the at least one nozzle is permitted thereby forming a second flow path directing fluid entering the housing inlet through the at least one nozzle; and wherein, when the first and second valve sleeves both are in the deployed position, flow through at least one nozzle is blocked and flow is permitted through the bypass channel forming a third flow path directing fluid entering the housing inlet through the bypass channel and out the housing outlet.

26. The abrasive perforator tool of claim 25 wherein the first and second valve sleeves are arranged end-to-end in the housing.

27. The abrasive perforator tool of claim 25 wherein the at least one bypass channel comprises a single bypass channel formed in the sidewall of the housing.

28. A bottom hole assembly comprising the abrasive perforator tool of claim 25.

29. A tool string comprising the bottom hole assembly of claim 28.

* * * * *